United States Patent [19]

Taguchi et al.

[11] 4,360,708

[45] Nov. 23, 1982

[54] SPEECH PROCESSOR HAVING SPEECH ANALYZER AND SYNTHESIZER

[75] Inventors: Tetsu Taguchi; Kazuo Ochiai, both of Tokyo, Japan

[73] Assignee: Nippon Electric Co., Ltd., Tokyo, Japan

[21] Appl. No.: 236,428

[22] Filed: Feb. 20, 1981

Related U.S. Application Data

[63] Continuation-in-part of Ser. No. 146,907, May 5, 1980, abandoned, which is a continuation of Ser. No. 25,520, Mar. 30, 1979, abandoned.

[30] Foreign Application Priority Data

| | | | |
|---|---|---|---|
| Mar. 30, 1978 | [JP] | Japan | 53-37495 |
| Mar. 30, 1978 | [JP] | Japan | 53-37496 |
| Apr. 20, 1978 | [JP] | Japan | 53-47264 |
| Apr. 24, 1978 | [JP] | Japan | 53-48955 |

[51] Int. Cl.[3] ..... G10L 1/00

[52] U.S. Cl. ..... 179/15.55 R

[58] Field of Search ..... 179/15.55 R, 1 SA; 340/870.19, 870.23; 375/58; 370/79, 118

[56] References Cited

U.S. PATENT DOCUMENTS

| | | | |
|---|---|---|---|
| 3,649,765 | 3/1972 | Rabiner et al. | 179/1 SA |
| 3,784,747 | 1/1974 | Berkley et al. | 179/1 FS |
| 4,066,842 | 1/1978 | Allen | 179/1 P |
| 4,133,976 | 1/1979 | Atal et al. | 179/1 P |
| 4,142,071 | 2/1979 | Croisiere et al. | 179/15.55 R |
| 4,184,049 | 1/1980 | Crochiere et al. | 179/1 SA |
| 4,216,354 | 8/1980 | Esteban et al. | 179/15.55 R |

*Primary Examiner*—Mark E. Nusbaum
*Assistant Examiner*—E. S. Kemeny
*Attorney, Agent, or Firm*—Sughrue, Mion, Zinn, Macpeak and Seas

[57] ABSTRACT

Adaptive bit allocation optimizes the encoded transmission of speech signal parameters. Allocation is controlled by a voiced/unvoiced decision signal derived from occurrence rate distributions of Partial Correlation Coefficient K1.

5 Claims, 7 Drawing Figures

SPEECH PROCESSOR HAVING SPEECH ANALYZER AND SYNTHESIZER

RELATED APPLICATION

The present application is a continuation-in-part application of the U.S. Application Ser. No. 146,907 filed May 5, 1980, now abandoned, which is a continuation of application of Tetsu Taguchi et al., Ser. No. 25,520, filed Mar. 30, 1979, now abandoned.

BACKGROUND OF THE INVENTION

This invention relates to a speech processor having a speech analyzer and synthesizer, which is useful, among others, in speech communication.

Band-compressed encoding of voice or speech sound signals has been increasingly demanded as a result of recent progress in multiplex communication of speech sound signals and in composite multiplex communication of speech sound and facsimile and/or telex signals through a telephone network. For this purpose, speech analyzers and synthesizers are useful.

As described in an article contributed by B. S. Atal and Suzanne L. Hanauer to "The Journal of the Acoustical Society of America," Vol. 50, No. 2 (Part 2), 1971, pages 637–655, under the title of "Speech Analysis and Synthesis by Linear Prediction of the Speech Wave," and as disclosed in the U.S. Pat. No. 3,624,302 issued to B. S. Atal, it is possible to regard speech sound as a radiation output of a vocal tract that is excited by a sound source, such as the vocal cords set into vibration. The speech sound is represented in terms of two groups of characteristic parameters, one for information related to the exciting sound source and the other for the transfer function of the vocal tract. The transfer function, in turn, is expressed as spectral distribution information of the speech sound.

By the use of a speech analyzer, the sound source information and the spectral distribution information are extracted from an input speech sound signal and then encoded either into an encoded or a quantized signal for transmission. A speech synthesizer comprises a digital filter having adjustable coefficients. After the encoded or quantized signal is received and decoded, the resulting spectral distribution information is used to adjust the digital filter coefficients. The resulting sound source information is used to excite the coefficient-adjusted digital filter, which now produces an output signal representative of the speech sound.

As the spectral distribution information, it is usually possible to use spectral envelope information that represents a macroscopic distribution of the spectrum of the speech sound waveform and thus reflects the resonance characteristics of the vocal tract. It is also possible to use, as the sound source information, parameters that indicate classification into or distinction between a voiced sound produced by the vibration of the vocal cords and a voiceless or unvoiced sound resulting from a stream of air flowing through the vocal tract (a fricative or an explosive), an average power or intensity of the speech sound during a short interval of time, such as an interval of the order of 20 to 30 milliseconds, and a pitch period for the voiced sound. The sound source information is band-compressed by replacing a voiced and an unvoiced sound with an impulse response of a waveform and a pitch period analogous to those of the voiced sound and with white noise, respectively.

On analyzing speech sound, it is possible to deem the parameters to be stationary during the short interval mentioned above. This is because variations in the spectral distribution or envelope information and the sound source information are the results of motion of the articulating organs, such as the tongue and the lips, and are generally slow. It is therefore sufficient in general that the parameters be extracted from the speech sound signal in each frame period of the above-exemplified short interval. Such parameters are well suited to synthesis or reproduction of the speech sound.

Usually, parameters $\alpha$ (predictive coefficients) specifying the frequencies and bandwidths of a speech signal and parameters K or the so-called PARCOR coefficients representing the variation in the cross sectional area of the vocal tract with respect to the distance from the larynx are used as the spectral distribution or envelope information. Parameters $\alpha$ can be obtained by using the well-known LPC technique, that is, by minimizing the mean-squared error between the actual values of the speech samples and their predicted values based on the past predetermined samples. These two parameters can be obtained by recursively processing the autocorrelation coefficients as by the so-called Durbin method discussed in "Linear Prediction of Speech," by J. D. Markel and A. H. Gray, Jr., Springer Verag, Berlin, Heldelberg, New York, 1976, and particularly referring to FIG. 3.1 at page 51 thereof. These parameters $\alpha$ and K adjust the coefficients of the digital filter, i.e., a recursive filter and a lattice filter, on the synthesis side.

Each of the foregoing parameters obtained on the analysis side (i.e., the transmitter side) is quantized in a preset quantizing step and a constant bit allocation, converted into digital signals and multiplexed.

In general, the occurrence rate distribution of values of some of the aforementioned parameters greatly differs depending on whether the original speech signal is voiced sound or unvoiced sound. A K parameter $K_1$ of the first order, a short-time mean power, and a predictive residual power, for instance, has an extremely different distribution for voiced sound or unvoiced sound (Reference is made to B. S. Atal and Lawrence R. Rabiner, "A Pattern Recognition Approach to Voiced-Unvoiced-Silence Classification with Application to Speech Recognition", IEEE Transactions on Acoustics, Speech and Signal Processing, Vol. ASSP-24, No. 3, June, 1976, particularly to p. 203, FIG. 3, FIG. 4 and FIG. 6 of the paper).

However, notwithstanding the fact that the value of $K_1$ is predominantly in the range of $+0.6$ to $+1.0$ for voiced sound (See the paper by B. S. Atal et al. above), encoding bits have been allocated for values in the other range ($-1.0$ to $+0.6$) in the conventional apparatus. This is contrary to the explicit objective of reducing the amount of transmission information. Consequently, it is difficult to achieve sufficient reduction of the amount of information to be transmitted, and also to restore the sufficient amount of required information.

It is to be pointed out in connection with the above that the parameters such as the sound source information are very important for the speech sound analysis and synthesis. This is because the results of analysis for deriving such information have a material effect on the quality of the synthesized speech sound. For example, an error in the measurement of the pitch period seriously affects the tone of the synthesized sound. An error in the distinction between voiced and unvoiced sounds renders the synthesized sound husky and crunching or thundering. Any one of such errors thus harms not only the naturalness but also the clarity of the synthesized sound.

As described in the cited reference by B. S. Atal and Lawrence R. Rabiner, it is possible to use various discrimination or decision parameters for the classification or distinction that have different values depending on whether the speech sounds are voiced or unvoiced. Typical discrimination parameters are the average power (short-time mean power), the rate of zero crossings, the maximum autocorrelation coefficient $\rho_{MAX}$ indicative of the delay corresponding to the pitch period, and the value of $K_1$.

However, none of the above discrimination parameters are sufficient as voiced-unvoiced decision information individually.

Accordingly, a new technique has been proposed in the Japanese Patent Disclosure Number 51-149705 titled "Analyzing Method for Driven Sound Source Signals", by Tohkura et al.

In this technique, the determination of optimal coefficients and threshold value for a discrimination function is difficult for the following reasons. In general, the coefficients and threshold value are decided by a statistical technique using multivariate analysis discussed in detail in a book entitled "Multivariate Statistical Methods for Business and Economics" by Ben W. Bolch and Cliff J. Huang, Prentice Hall, Inc., Englewood Cliffs, N.J., USA, 1974 especially in Chapter 7 thereof. In this technique, the coefficients and threshold value with the highest discrimination accuracy are determined when the occurrence rate distribution characteristics of the discrimination parameter values for both voiced and unvoiced sounds are a normal distribution with an equal variance. However, inasmuch as the variance of occurrence rate distribution characteristics of $K_1$ and $\rho_{MAX}$ selected as the discrimination parameters for voiced and unvoiced sounds differ extremely as stated, no optimal coefficients and threshold value are determined.

SUMMARY OF THE INVENTION

Accordingly, an object of the present invention is to provide a speech processor capable of reducing the redundant information or improving the quality of the reproduced speech signal by optimal allocation of the encoding bits.

Another object of this invention is to provide a speech processor which permits high-accuracy discrimination of voiced and unvoiced sounds.

According to the present invention, there is provided a speech processor including a speech analysis part and a speech synthesis part in which said speech analysis part comprises: means supplied with a speech signal sampled by a predetermined frequency for developing parameter signals representative of speech spectrum information signals and speech source information signals of said speech signal containing a voiced and unvoiced discrimination signal, a pitch period signal and a short-time mean power signal; and means responsive to said discrimination signal for quantizing said parameter signals and encoding said quantized parameter signals in a predetermined allocation of encoding bits so that the encoding bits may be concentrically allocated for the values of said parameters having high occurrence rate; and in which said speech synthesis part comprises: a decoder responsive to said discrimination signal for decoding the encoded parameter signals to reform the quantized value; and a synthesizing digital filter having the coefficients determined by said speech spectrum information signals and being excited by said speech source signals. Further, in the analysis part said means for developing said discrimination signal in said speech processor comprises: a discrimination means responsive to discrimination parameter signals whose value are different between voiced and unvoiced sounds selected among said parameter signals for evaluating a discrimination function expressed in the form of the summation of said discrimination parameter signals each weighted by a predetermined coefficient and for comparing the value of said discrimination function with a predetermined threshold value, said discrimination parameter signals being at least two parameter signals selected among the partial autocorrelation coefficient signals (K-parameters) of the 1st to the m-th order representing said speech spectrum information at delay 1 to m sampling periods (m designates a natural number) and a parameter signal $\rho_{MAX}$ defined as a ratio of a maximum autocorrelation coefficient for a predetermined delay time range to that for zero delay time, or said discrimination parameter signals being a log area ratio signal defined as $\log (1+K_1)/(1-K_1)$ and a parameter signal $\rho_{MAX}$ defined as a predetermined nonlinearly converted signal of said $\rho_{MAX}$.

The present invention will now be described referring to the drawings.

DESCRIPTION OF THE PREFERRED EMBODIMENTS

Figure 1:
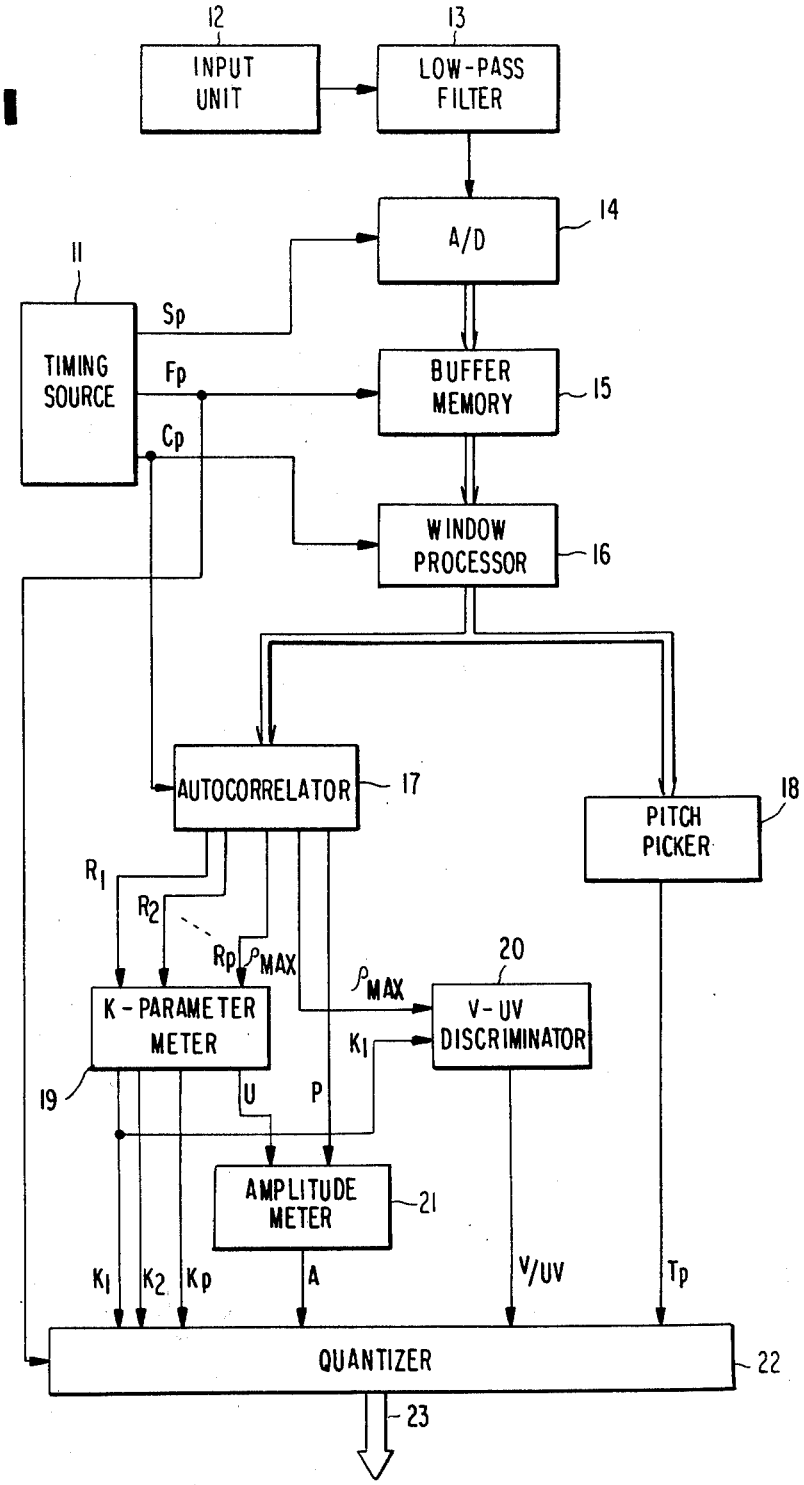
FIGS. 1 and 5 show block diagrams of the speech analysis and synthesis units according to the invention.

Referring to FIG. 1, a speech analyzer according to a first embodiment of the present invention is for analyzing speech sound having an input speech sound waveform into a plurality of signals of a first group representative of spectral envelope information of the waveform and at least two signals of a second group representing sound source information of the speech sound. The speech sound has a pitch period of a value variable between a shortest and a longest pitch period. The speech analyzer comprises a timing source 11 having first through third output terminals. The first output terminal is for a sampling pulse train $S_p$ for defining a sampling period or interval. The second output terminal is for a framing pulse train $F_p$ for specifying a frame period for the analysis. When the sampling pulse train $S_p$ has a sampling frequency of 8 kHz, the sampling interval is 125 microseconds. If the framing pulse train $F_p$ has a framing frequency of 50 Hz, the frame period is 20 milliseconds and is equal to one hundred and sixty sampling intervals. The third output terminal is for a clock pulse train $C_p$ for use in calculating autocorrelation coefficients and may have a clock frequency of, for example, 4 MHz. It is to be noted here that a signal and the quantity represented thereby will often be designated by a common symbol in the following.

The speech analyzer shown in FIG. 1 further comprises those known parts which are to be described merely for completeness of disclosure. A mathematical combination of these known parts is an embodiment of the principles described by John Makhoul in an article he contributed to "Proceedings of the IEEE," Vol. 63, No. 4 (April 1975), pages 561–580, under the title of "Linear Prediction: A Tutorial Review."

Among the known parts, an input unit 12 is for transforming the speech sound into an input speech sound signal. A low-pass filter 13 is for producing a filter output signal wherein those components of the speech sound signal are rejected which are higher than a predetermined cutoff frequency, such as 3.4 kHz. An analog-to-digital converter 14 is responsive to the sampling pulse train $S_p$ for sampling the filter output signal into samples and converting the samples to a time sequence of digital codes of, for example, twelve bits per sample. A buffer memory 15 is responsive to the framing pulse train $F_p$ for temporarily memorizing a first preselected length, such as the frame period, of the digital code sequence and for producing a buffer output signal consisting of successive frames of the digital code sequence, each frame followed by a next succeeding frame.

A window processor 16 is another of the known parts and is for carrying out a predetermined window processing operation on the buffer output signal to improve the approximation of the representation of the segment of the voiced sound as a convolution of a periodic impulse train with a time invariant. More particularly, the processor 16 memorizes at first a second preselected length, called a window period for the analysis, of the buffer output signal. The window period may, for example, be 30 milliseconds. A buffer output signal segment memorized in the processor 16 therefore consists of a present frame of the buffer output signal and that portion of a last or next previous window frame of the buffer output signal which is contiguous to the present frame. The processor 16 subsequently multiplies the memorized signal segment by a window function, such as a Hamming window function as described in the U.S. Pat. No. 3,649,765, especially FIG. 1 thereof wherein a window function modulator is designated by numeral 11. The buffer output signal is thus processed into a windowed signal. The processor 16 now memorizes that segment of the windowed signal which consists of a finite sequence of a predetermined number N of windowed samples $X_i$ ($i=0, 1, \ldots, N-1$). The predetermined number N of the samples $X_i$ in each window period amounts to two hundred and forty for the numerical example.

Responsive to the windowed samples $X_i$ read out of the window processor 16 in response to the clock pulse $C_p$, an autocorrelator 17 produces a preselected number p of coefficient signals $R_1, R_2, \ldots$, and $R_p$ and a power signal P. The preselected number p may be ten. For this purpose, an autocorrelation coefficient sequence of first through p-th order autocorrelation coefficients R(1), R(2), . . . , and R(p), are calculated according to:

$$R(d) = \left( \sum_{i=0}^{N-1-d} X_i \cdot X_{i+d} \right) / P \tag{1}$$

where d represents orders of the autocorrelation coefficients R(d), namely, those delays or joining periods or intervals for reference members and sets of joint members for calculation of the autocorrelation coefficients R(d) which are varied from one sampling interval to p sampling intervals. As the denominator in Equation (1) and for the power signal P, an average power P is calculated for each window period by that part of the autocorrelation 17 which serves an average power calculator. The average power P is given by:

$$P = \sum_{i=0}^{N-1} X_i^2.$$

Figure 2:
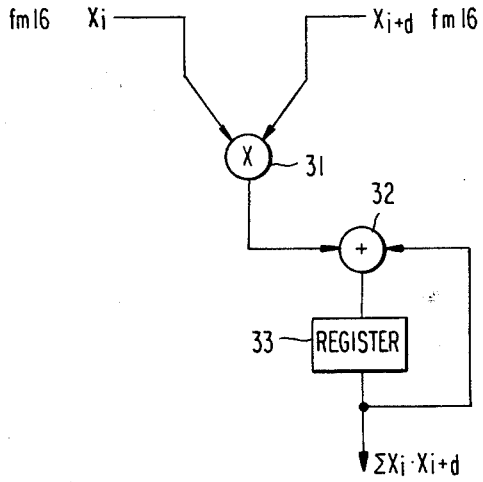
FIG. 2 shows a block diagram of a part of the circuit shown in FIG. 1.

The autocorrelator 17 may be of the product-summation type shown in FIG. 2. Wave data $X_i$ and another wave data $X_{i+d}$ spaced by d sample periods from the wave data $X_i$ are applied to a multiplier 31 of which the output signal is applied to an adder 32. The output signal from the adder 32 is applied to a register 33 of which the output is coupled with the other input of the adder 32. Through the process in the instrument shown in FIG. 2, the numerator components of the autocorrelation coefficient R(d) shown in equation (1) are obtained as the output signal from the register 33 (the denominator component, i.e., the short time average power, corresponds to the output signal at delay $d=0$). The autocorrelation coefficient R(d) is calculated by using these components in accordance with the equation (1).

Supplied with the coefficient signals R(d), a linear predictor or K-parameter meter 19 produces first through p-th parameter signals $K_1, K_2, \ldots$, and $K_p$ respresentative of spectral envelope information of the input speech sound waveform and a single parameter signal U representative of intensity of the speech sound. The spectral envelope information is derived from the autocorrelation coefficients R(d) as partial correlation coefficients or "K parameters" $K_1, K_2, \ldots$, and $K_p$ by recursively processing the autocorrelation coefficients R(d), as by the Durbin method discussed in the Makhoul article "Linear Prediction: A Tutorial Review", cited above, particularly in equations (12), (37) and (38a) through (38e) and in the book "Linear Prediction of Speech" especially in FIG. 3.1 at page 51 thereof. The intensity is given by a normalized predictive residual power U calculated in the meantime.

In response to the power signal P and the single parameter signal U, an amplitude meter 21, another one of the known parts, produces an amplitude signal A representative of an amplitude A given by $\sqrt{(U \cdot P)}$ as amplitude information of the speech sound in each window period. The first through the p-th parameter signals $K_1$ to $K_p$ and the amplitude signal A are supplied to an encoder 22 together with the framing pulse train $F_p$ in the manner known in the art.

A pitch picker 18 measures the pitch period from the output of the window processor 16 by a well-known method as disclosed in an article "A Comparative Performance Study of Several Pitch Detection Algorithms" by L. R. Rabiner et al., IEEE Transaction on Acoustic, Speech and Signal Processing, Vol. ASSP-24, No. 5, October 1976, especially in FIGS. 2 and 3 thereof.

A voiced/unvoiced discriminator 20 discriminates voiced or unvoiced sound according to the present invention as will be disclosed later using parameters such as $K_1$ and $\rho_{MAX}$. The discriminator 20 provides logical outputs "1" and "0" representative of voiced and unvoiced sounds, respectively.

Figure 3:
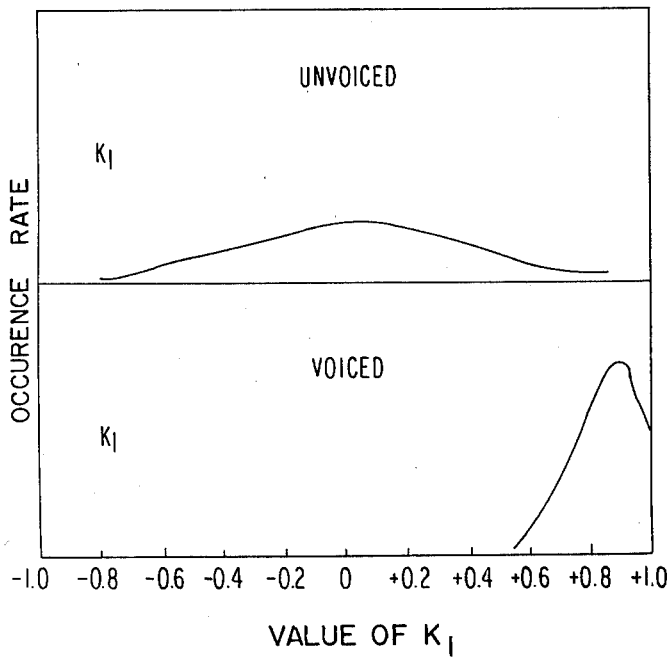
FIG. 3 shows the occurrence rate distribution of the value $K_1$.

In the encoders 22, each parameter signal is sampled to obtain a digital sample, next the digital sample is quantized to one of a set of discrete amplitude values and then the quantized value is encoded as a word of N binary bits in response to a signal from the voiced/unvoiced discriminator 20 according to the occurrence rate distribution characteristics of each parameter value. As shown in FIG. 3 where the typical distribution of $K_1$ is presented, the parameter $K_1$ for voiced sounds are concentrated between +0.6 and +1.0, while those for unvoiced sounds are distributed roughly over −0.7 to +0.7. Therefore, when quantizing $K_1$ for voiced sound it is desirable to allocate encoding bits to the +0.6 to +1.0 range. Encoding bits are allocated to a region of −0.7 to +0.7 and encoding is done for unvoiced sound.

Figure 4:
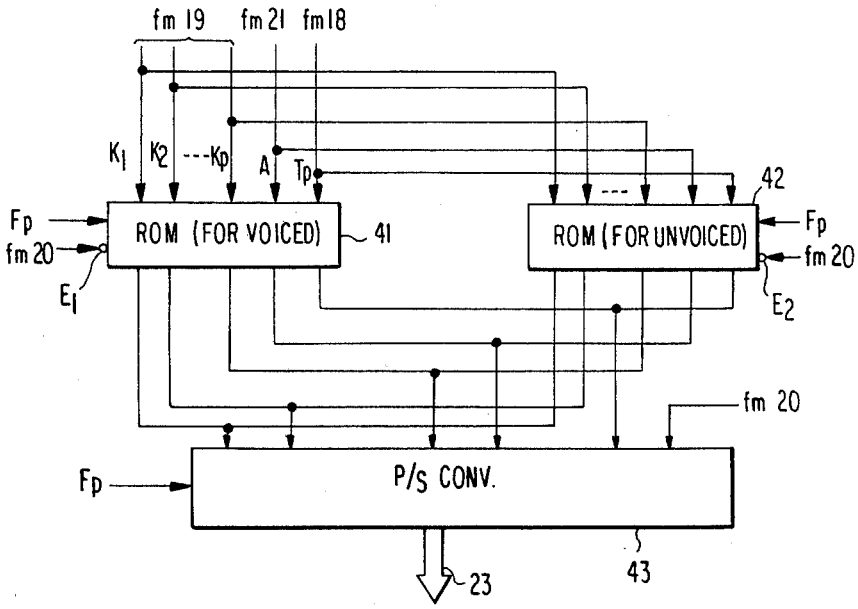
FIGS. 4 and 6 show block diagrams of a quantizer and decoder shown in FIGS. 1 and 5.

Likewise, optimal encoding of other parameters is done by allocating encoding bits conforming to the distribution when encoding K parameters $K_2$ of the second order whose distribution of values differs for voiced and unvoiced sounds, or $A=\sqrt{PU}$ (equivalent to average power) which shows amplitude information. When values obtained are outside of the allocated range, they will be made coincident with the contiguous values of the range. Encoding means in the encoder 22 may be made of two ROMs each serving as a conversion table between an input binary signal and a modified binary signal. To describe in more detail, for encoding of $K_1$ into a binary signal of 7 bits, which corresponds to a voiced sound, each value obtained by equally dividing the value of +0.6 to +1.0 into 128 parts is used as an address to allow the data corresponding to 1 to 128 to be memorized in the ROM as quantization values. Similarly for an unvoiced sound, each value obtained by equally dividing the value of −0.7 to +0.7 into 128 parts is used as an address for another ROM. These ROMs are alternatively read out depending on whether the speech signal represents the voiced or unvoiced sound. Referring to FIG. 4, ROMs 41 and 42, having chip enable terminals $E_1$ and $E_2$, respectively, are complementarily activated by a signal supplied to the chip enable terminals. In other words, ROM 41 is activated when the logical signal "1" is provided to the terminal $E_1$, on the other hand, ROM 42 is activated when the logical signal "0" is supplied to the terminal $E_2$. This complementary activation may be realized by adding an inverter to one of the enable terminals of the ROMs. When the logical signal "1" is supplied to the terminals $E_1$ and $E_2$, encoded data are read out from the ROM 41 for every frame interval responsive to the frame pulse $F_p$. Then, the encoded data are transmitted to the transmission line 23 through a well-known P/S (parallel to serial) converter 43. Similarly, in the case of an unvoiced sound, the logical signal "0" is supplied to the terminals $E_1$ and $E_2$, and encoded data read out from the ROM 42 are transmitted to the transmission line 23. Thus, the encoded outputs are obtained as the ROM output in response to the parameters such as $K_1, K_2, \ldots$, A and $T_p$. These optimal bit allocations can be determined based upon the occurrence rate distribution of each of the parameters obtained by analyzing the speech signals of representative speakers. For encoding the quantized parameters such as $K_3, K_4, \ldots, K_p$ and pitch period $T_p$ such that there will be no apparent difference in the occurrence rate distribution for voiced and unvoiced sounds, the ROMs are used in the usual way without any partial bit allocation.

Figure 5:
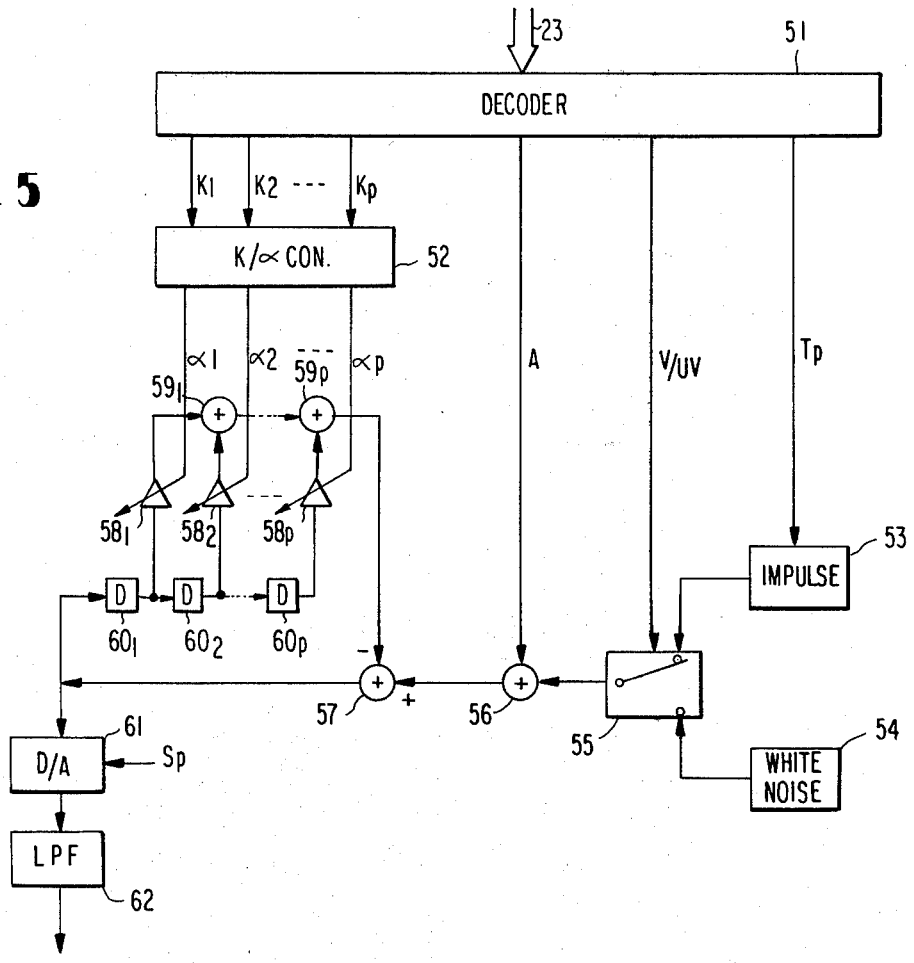

The transmission line 23 is capable of transmitting data of 3600 bits/sec, for example, and leads the data of 72 bits/frame and 20 msec frame period, i.e., of 3600 Baud, to a decoder 51 on the synthesis side shown in FIG. 5.

Figure 6:
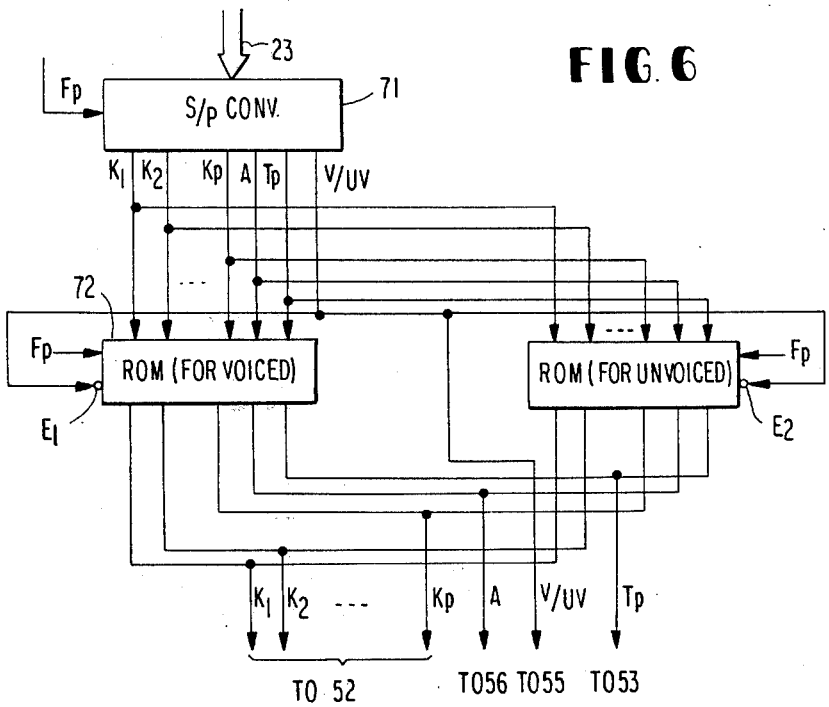

The decoder 51 detects the frame synchronizing bit of the data in the form of a frame pulse $F_p$ fed through the transmission line 23, and decodes these data by using the circuit as shown in FIG. 6.

The decoder 51 may also be made of the ROMs 72 and 73 for voiced and unvoiced sounds whose addresses and memorized data have an inverse relation to those in the encoder 22 described above and a well known S/P (serial to parallel) converter 71 as shown in FIG. 6. In a word, output quantized data and input parameter values of the ROMs 41 and 42 for each parameter are memorized as an address and output data, respectively, in the ROMs 72 and 73 in the form of the conversion table. Supplied with logical data signal representing voiced or unvoiced sound obtained through the S/P converter 71 in response to the frame pulse $F_p$ to enable terminals $E_1$ and $E_2$, ROMs 72 and 73 can be complementarily activated and the parameters K ($K_1, K_2, \ldots, K_p$), A, and $T_p$ are supplied to a $K/\alpha$ converter 52, a multiplier 56 and an impulse generator 53.

The impulse generator 53 generates a train of impulses with the same period as the pitch period $T_p$ and supplies it to one of the fixed contacts of a switch 55. The noise generator 54 generates white noise for transfer to the other fixed contact of the switch 55. The switch 55 couples the inpulse generator through a movable contact with the multiplier 56 when the logical signal indicates the voiced sound. On the other hand, when the logical signal indicates an unvoiced sound, the switch 55 couples the noise generator 54 with the multiplier 56.

The multiplier 56 multiplies the impulse train or the white noise passed through the switch 55 by the exciting amplitude information, i.e., the amplitude coefficient A, and sends the multiplied output to a transversal filter comprised of adders 57, $\mathbf{59}_1, \ldots, \mathbf{59}_p$, multipliers $\mathbf{58}_1, \mathbf{58}_2, \ldots, \mathbf{58}_p$ and one-sample period delays $\mathbf{60}_1, \mathbf{60}_2, \ldots, \mathbf{60}_p$. The adder 57 provides a summation of the output signal from the multiplier 56 and the signal delivered from the adder $\mathbf{59}_2$ and delivers the sum to the delay $\mathbf{60}_1$ and to a digital to analog (D/A) converter 61. The delay $\mathbf{60}_1$ delays the input signal by one sampling period in the A/D converter 14 and sends the output signal to the multiplier $\mathbf{58}_1$ and to the delay $\mathbf{60}_2$. Similarly, the output signal of the delay $\mathbf{60}_2$ is applied to the multiplier $\mathbf{58}_2$ and the next stage one-sample period delay. In a similar manner, the output of the adder 57 is successively delayed finally through one-sample period delay $\mathbf{60}_p$ and then is applied to the multiplier $\mathbf{58}_p$. The multiplier factors of the multipliers $\mathbf{58}_1$, $\mathbf{58}_2$ and $\mathbf{58}p$ are determined by $\alpha$ parameters supplied from $K/\alpha$ converter 52. The result of the multiplication of each multiplier is successively added in adders $\mathbf{59}_1$ and $\mathbf{59}_p$.

The $K/\alpha$ converter 52 converts K parameters into linear predictor coefficients $\alpha_1, \alpha_2, \alpha_3, \ldots, \alpha_p$ by the recursive method mentioned above, and delivers $\alpha_1$ to the multiplier $\mathbf{58}_1$, $\alpha_2$ to the multiplier $\mathbf{58}_2, \ldots$ and $\alpha_p$ to the multiplier $\mathbf{58}_p$.

The $K/\alpha$ converter 52 can also be composed of a similar processor to the K-parameter meter 17 as mentioned in the cited book by J. D. Markel et al.

The adders 57, $\mathbf{59}_1, \ldots \mathbf{59}_p$, the one-sample delays $\mathbf{60}_1, \mathbf{60}_2, \ldots, \mathbf{60}_p$, and the multipliers $\mathbf{58}_1, \mathbf{58}_2, \ldots, \mathbf{58}_p$ cooperate to form a speech sound synthesizing filter. The synthesized speech sound is converted into analog form by the D/A converter 61 and then is passed through a low-pass filter 62 of 3400 Hz so that the synthesized speech sound is obtained.

In the circuit thus far described, the speech analysis part from the speech sound input to the encoder 22 may be disposed at the transmitting side, the transmission line 23 may be constructed by an ordinary telephone line, and the speech synthesis part from the decoder 51 to the output terminal of the low pass filter 62 may be disposed at the receiving side.

As stated above, by quantizing each parameter with an optimal allocation of quantizing bits corresponding to voiced sound and unvoiced sound of the speech signal, the sound quality of the synthesized sound on the synthesis side can be improved through quantizing the parameters by optimal bits allocation for the same amount of transmission information. It is clear that the amount of transmission information can be reduced because the number of encoding bits required to assure the same sound quality can be minimized.

As previously described, the conventional discrimination based on the multivariate analysis of voiced/unvoiced sounds using a linear discrimination (decision) function has difficulty in determining optimal coefficients or threshold values, because of the difference in variance of discrimination parameters between voiced and unvoiced sounds. The discrimination accuracy is therefore inevitably lowered.

A log area ratio taking logarithmic values of a specific cross-sectional area of a vocal tract is sometimes used for the purpose of reducing transmission and memory volumes (Reference is made to "Quantization Properties of Transmission Parameters in Linear Predictive Systems" by R. Viswanathan and John Makhoul, IEEE Transactions on Acoustics, Speech and Signal Processing, Vol. ASSP-23, No. 3, June 1975). Here, a specific sectional area ratio of a vocal tract of the "n"-th order is a ratio of a representative value of each cross-sectional area existing on both sides of a border from the opening section (lips) to the nVoTo length where the sound velocity is Vo and sampling period (equivalent to the sampling period of the A/D converter 14 in FIG. 1) is To. As this representative value, the average value of the cross-sectional area of the vocal tract existing inside the length (VoTo) equivalent to the sampling spacing is used. As stated, the K parameter represents a reflection coefficient in the vocal tract, and the average value of the specific cross-sectional area of the vocal tract can be expressed by $(1+K_n)/(1-K_n)$. Therefore, the log area ratio will be log $(1+K_n)/(1-K_n)$, assuming the K parameter to be in the form of nonlinear conversion. In this instance, n is equivalent to the order of K.

Inasmuch as variance of occurrence rate distribution characteristics of this log area ratio value for voiced and unvoiced sounds nearly coincide, the shortcomings as experienced with the conventional apparatuses can be eliminated by using the log area ratios as discrimination parameters, permitting more accurate discrimination of voiced and unvoiced sounds. Among the K parameters, those higher than the third order have less differences in the variance and can be used directly as discrimination parameters.

By applying non-linear conversion for $\rho_{MAX}$, for example, by the following expression, $$\rho'_{MAX}=a\cdot\rho_{MAX}/(b-c\cdot\rho_{MAX}) \quad (2)$$

where a, b and c designate constant values, the difference in variance of the occurrence rate distribution characteristics of $\rho_{MAX}$ for both voiced and unvoiced sounds can be reduced. The foregoing nonlinear conversion, in general, increases operation quantities. Consequently, if a slight degradation of the discrimination accuracy is tolerated. $\rho_{MAX}$ can be used directly as a discrimination parameter, because of less deviation of the distribution compared with $K_1$.

Figure 7:
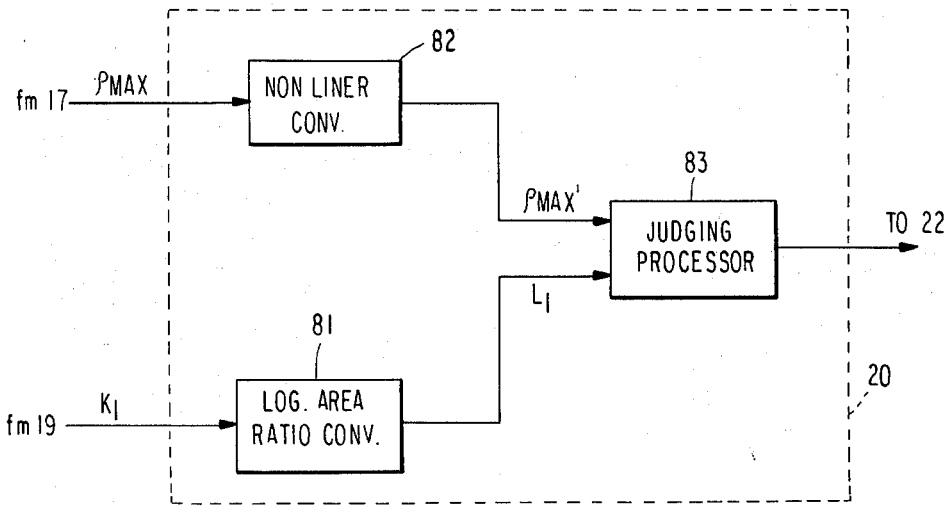
FIG. 7 shows a block diagram of a voiced and unvoiced discrimination unit according to the invention.

High accuracy discrimination circuit of voiced and unvoiced sounds by the V/UV discrimination 20 in FIG. 1 will be described referring to FIG. 7. $K_1$ and $\rho_{MAX}$ extracted by the K-parameter meter 19 and the autocorrelator 17 shown in FIG. 1 are supplied to the log area ratio converter 81 and the non-linear converter 82. Each of the converters 81 and 82 has a ROM in which parameters $K_1$ or $\rho_{MAX}$ and corresponding log area ratio values or $\rho'_{MAX}$ calculated from the $K_1$ and $\rho_{MAX}$ are stored in advance. The ROMs supply to a judging processor 83 the corresponding log area ratio $L_1$ converted from $K_1$, and $\rho'_{MAX}$ as address. The judging processor 83 judges whether the speech sound is voiced or unvoiced sound by comparing the value of the discrimination function expressed in (3) and the predetermined discrimination threshold value $T_h$:

$$B_1L_1+B_2\rho'_{MAX} \quad (3)$$

where $B_1$ and $B_2$ designate optimal coefficients for the discrimination.

An evaluation method of optimal coefficients and threshold value will be shortly described in the following. The plane with $L_1$ and $\rho'_{MAX}$ as an ordinate and an abscissa, is divided into three regions, i.e., the first region representing a voiced region, the second region representing an unvoiced region and, the third region where the discrimination between the voiced and unvoiced sounds is impossible. It is the so-called linear discrimination function representative of the straight line which divides the plane in order to obtain the minimum misjudging rate of voiced and unvoiced sounds. The most optimal discrimination coefficients and the threshold value can be evaluated by the statistical technique using multivariate analysis.

In the analysis, $K_1$ and $\rho_{MAX}$ are derived at converters 81 and 82 from the preselected training speech signals which are manually classified into voiced and unvoiced sounds in a frame period 20 msec by using the autocorrelator 17 and the K parameter meter 19 as shown in FIG. 1. Thus obtained data are defined as follows: $N_v$ and $N_{uv}$ show the total number of voiced and unvoiced frames; and $X_{111}, X_{112}, \ldots, X_{11N_v}$ and $X_{121}, X_{122}, \ldots, X_{12N_v}$, the values of $L_1$ and $\rho'_{MAX}$ of the first, second, . . . , $N_v$-th voiced frames of the training speech signals, respectively. Similarly, $X_{211}, X_{212}, \ldots, X_{21N_{uv}}$ and $X_{221}, X_{222}, \ldots, V_{22N_{uv}}$ represent the values of $L_1$ and $\rho'_{MAX}$ of the first, second, . . . , $N_{uv}$-th unvoiced frames, respectively.

Data matrix X' may be expressed as:

$$X' = \begin{bmatrix} X_{111}\, X_{112} \ldots X_{11N_v} & X_{211}\, X_{212} \ldots X_{21N_{uv}} \\ X_{121}\, X_{122} \ldots X_{12N_v} & X_{221}\, X_{222} \ldots X_{22N_{uv}} \end{bmatrix} \quad (4)$$

$$= [X'_1\, X'_2]$$

where $X_1'$ and $X_2'$ represent the groups of $K_1$ and $\rho_{MAX}$ in the voiced and unvoiced frames.

The average vector of $X_1'$, $X_2'$ is given by $$\bar{X}'_1 = [\bar{X}_{11}\ \bar{X}_{12}] \tag{5}$$

$$\bar{X}'_2 = [\bar{X}_{21}\ \bar{X}_{22}] \tag{6}$$

where $X_{1i}$ and $X_{2i}$ are given by formula as follows:

$$\bar{X}_{1i} = \frac{1}{Nv} \sum_{j=1}^{Nv} X_{1ij} \tag{7}$$

$$\bar{X}_{2i} = \frac{1}{Nuv} \sum_{j=1}^{Nuv} X_{2ij} \tag{8}$$

A covariance matrix $X'_1X_1$ of the parameters in the voiced frames (in the first region) can be computed in accordance with the following sequences:

$$X'_1 = \begin{bmatrix} X_{111}\ X_{112} \ldots X_{11Nv} \\ X_{121}\ X_{122} \ldots X_{12Nv} \end{bmatrix} - \begin{bmatrix} \bar{X}_{111}\ \bar{X}_{112} \ldots \bar{X}_{11Nv} \\ \bar{X}_{121}\ \bar{X}_{122} \ldots \bar{X}_{12Nv} \end{bmatrix} \tag{9}$$

$$= \begin{bmatrix} X_{111}\ X_{112} \ldots X_{11Nv} \\ X_{121}\ X_{122} \ldots X_{12Nv} \end{bmatrix}$$

$$X'_1X_1 = \begin{bmatrix} \sum_{i=1}^{Nv} X_{11i}^2 & \sum_{i=1}^{Nv} X_{11i} \cdot X_{12i} \\ \sum_{i=1}^{Nv} X_{12i} \cdot X_{11i} & \sum_{i=1}^{Nv} X_{12i}^2 \end{bmatrix} \tag{10}$$

Similarly a covariance matrix $X'_2\ X_2$ of the parameters in the unvoiced frames (in the second region) may be computed according to the equation (11):

$$X'_2X_2 = \begin{bmatrix} \sum_{i=1}^{Nuv} X_{21i}^2 & \sum_{i=1}^{Nuv} X_{21i} \cdot X_{22i} \\ \sum_{i=1}^{Nuv} X_{22i} \cdot X_{21i} & \sum_{i=1}^{Nuv} X_{22i}^2 \end{bmatrix} \tag{11}$$

A covariance matrix $S_*$ of the third region can be evaluated according to the following equation:

$$S_* = \frac{1}{Nv + Nuv - 2} (X'_1X_1 + X'_2X_2) \tag{12}$$

Therefore, the coefficient vector B and the discrimination threshold TH representing the weight coefficients and the threshold value of the discrimination function may be computed in accordance with the equations (13) and (14):

$$B = S_*^{-1} (\bar{X}_1 - \bar{X}_2) \tag{13}$$

$$TH = \tfrac{1}{2} B^{-1} (\bar{X}_1 + \bar{X}_2) \tag{14}$$

Arithmetic operations in a fashion similar to that described above are shown in greater detail in the cited reference entitled "Multivariate Statistical Methods for Business and Economics" especially in Chapter 7, and further details of computing the discrimination coefficients and threshold value are listed in Fortran language in the Appendix to this application.

In the Appendix, the data symbol XL (A, B, C) denotes classified data representative of $L_1$ and $\rho'_{MAX}$ in accordance with voiced or unvoiced sound; AV (A, B), an average vector of the parameter for voiced or unvoiced frames; XS (A, B), a deviation vector $X'_1$, $X'_2$ from the average vector; COV 1 (A, B) and COV 2 (A, B), covariance matrixes $X'_1X_1$ and $X'_2X_2$ for voiced and unvoiced sounds; S (A, B), a covariance matrix $S_*$ obtained from the covariances COV 1 and COV 2; SINV (A, B), an inverse matrix of S (A, B); BETA (D), the discrimination coefficient vector B of the discrimination function. Furthermore, with regard to declarators in the parenthesis, the first declarator A denotes the distinction of voiced and unvoiced sounds; 1 and 2, voiced and unvoiced sounds; the second declarator B, discrimination parameters; 1 and 2, $L_1$ and $\rho'_{MAX}$; the third declarator C, a frame number of voiced or unvoiced sound; the declarator D, the discrimination coefficients for the parameters; 1 and 2, those for $L_1$ and $\rho'_{MAX}$.

In the aforementioned embodiment, non-linearly converted parameters $L_1$ and $\rho'_{MAX}$ are used as the discrimination parameters. However, it is clear that other parameters, e.g., K parameters of the "N"-th order equal to or higher than the second order, may be used as the discrimination parameters. The parameters having less deviation of the distribution than that of $K_1$ such as $\rho_{MAX}$, $K_2$, $K_3$, . . . can also be used as the discrimination parameters without any conversion technique, and it causes the reduction of operative quantities as described before.

After determining the discrimination coefficients and the threshold value TH as stated above, the discrimination between voiced and unvoiced sounds is done for the speech sound signal to be analyzed by comparing the value of the discrimination function expressed in the form of the sum value of the weighted discrimination parameters with the discrimination threshold value TH for each present analysis frame.

APPENDIX

```
C**** GENERATE DISCRIMINATION COEFFICIENTS
      AND THRESHOLD
      DIMENSION XL (2, 2, 8000), AV (2, 2),
      XS (2, 2, 8000), XS (2, 2, 8000), COV 1(2, 2) COV 2
      (2, 2), S (2, 2), SINV (2, 2), BETA (2)
C**** COMPUTE AVERAGE VECTOR (AV)
      DO 10    I = 1, 2
      DO 10    J = 1, 2
   10 AV (I, J) = 0, 0
      DO 11    I = 1, NV
      DO 11    J = 1, 2
   11 AV (1, J) = AV (1, J) + XL (1, I, J)
      DO 12    I = 1, NUV
      DO 12    J = 1, 2
   12 AV (2, J) = AV (2, J) + XL (2, I, J)
      DO 13    I = 1, 2
      AV (1, I) = AV (1, I)/NV
   13 AV (2, I) = AV (2, I)/NUV
C**** GENERATE DEVIATION MATRIX (XS)
      DO 20    I = 1, 2
      DO 21    J = 1, NV
   21 XS (1, I, J) = XL (1, I, J) - AV (1, I)
      DO 22    J = 1, NUV
   22 XS (2, I, J) = XL (2, I, J) - AV (2, I)
   20 CONTINUE
C**** GENERATE COVARIANCE MATRIX (COV 1,
      COV 2)
      DO 30    I = 1, 2
      DO 30    J = 1, 2
      COV 1 (I, J) = 0, 0
   30 COV 2 (I, J) = 0, 0
      DO 31    I = 1, 2
      DO 31    J = 1, 2
      DO 32    K = 1, NV
   32 COV 1 (I, J) = COV 1 (I, J) +
      XS (1, I, K) * XS (1, J, K)
      DO 33    K = 1, NUV
   33 COV 2 (I, J) = COV 2 (I, J) +
      XS (2, I, K) * XS (2, J, K)
   31 CONTINUE
```

APPENDIX-continued

```
C**** GENERATE COVARIANCE MATRIX (S)
      DO 40    I = 1, 2
      DO 41    J = 1, 2
 41   S (I, J) = COV 1 (I, J) + COV 2 (I, J)
 40   S (I, J) = S (I, J)/(NV + NUV − 2)
C**** GENERATE INVERSE MATRIX (SINV)
      DO 50    I = 1, 2
      DO 50    J = 1, 2
 50   SINV (I, J) = S (I, J)
      CALL SAINVC (2, 2, SINV)
C**** GENERATE BETA VECTOR (BETA)
      DO 60    I = 1, 2
      BETA (1)     = 0, 0
      DO 61    J = 1, 2
 61   DATA (I) = BETA (I) + SINV (I, J) * (AV (1, J) −
      AV (2, J))
 60   CONTINUE
C**** GENERATE THRESHOLD (TH)
      TH = 0, 0
      DO 70    I = 1, 2
 70   TH = TH + BETA (I) * (AV (1, I) + AV (2, I))
      TH = TH/2
C**** SUBROUTINE FOR GENERATING INVERSE
      MATRIX
      SUBROUTINE SAINVC (2, 2, A)
      DIMENSION A (2, 2)
      DO 20    K = 1, 2
      A (K, K) = −1.0/A (K, K)
      DO 5     I = 1, 2
      IF (I − K) 3, 5, 3
  3   A (I, K) = −A (I, K) * A (K, K)
  5   CONTINUE
      DO 10    I = 1, 2
      DO 10    J = 1, 2
      IF (I − K) * (J − K)) 9, 10, 9
  9   A (I, J) = A (I, J) − A (I, K) * A (K, J)
 10   CONTINUE
      DO 20    J = 1, 2
      IF (J − K) 18, 20, 18
 18   A (K, J) = −A (K, J) * A (K, K)
 20   CONTINUE
      DO 25    I = 1, 2
      DO 25    J = 1, 2
 25   A (I, J) = −A (I, J)
      RETURN
      END
```

What is claimed is:

1. A speech processor including a speech analysis part for receiving and analyzing a speech sound and generating analysis signals representing said speech sound and a speech analysis part for reproducing said speech sound from said analysis signals, in which said speech analysis part comprises:

means for generating a series of samples at a predetermined frequency representing said speech sound, a predetermined number of successive samples comprising an analysis frame period;

means for receiving said samples and for developing parameter signals including speech sound spectrum and sound source information signals representing said speech sound for each said frame period, said speech sound source information signals including a voiced or unvoiced discrimination signal, pitch period signal and short-time mean power signal; and means for quantizing and encoding each of said parameter signals, said encoding being performed for predetermined parameter signals in a predetermined number of encoding bits covering a range of values having a high rate of occurrence for each said predetermined parameter signals, said range of values for any one of said predetermined parameter signals differing in accordance with said voiced or unvoiced discrimination signal;

and in which said speech synthesis part comprises:

a decoder responsive to said voiced or unvoiced discrimination signal for decoding said encoded parameter signals; and a synthesizing digital filter having coefficients determined by said speech sound spectrum information signals and excited by said speech sound source information signals.

2. A speech processor according to claim 1, in which said means for developing said discrimination signal comprises:

means for generating discrimination parameter signals from selected ones of said parameter signals, said discrimination parameter signals having values which differ between voiced and unvoiced sounds;

a discrimination means responsive to said discrimination parameter signals for generating discrimination function signals by weighting each of said discrimination parameter signals by a predetermined coefficient and combining said weighted signals, and for comparing the value of said discrimination function signals with a predetermined threshold signal.

3. A speech processor according to claim 2, in which said parameter signals include partial autocorrelation coefficient signals (K-parameters) of the 1st to m-th order of the signal samples representing said speech spectrum information at delay of 1 to m sampling periods (m designates natural number) and a parameter signal $\rho_{MAX}$ defined as a ratio of the maximum autocorrelation coefficient of the signal samples for a predetermined delay time range to the maximum autocorrelation coefficient for zero delay time, and wherein said discrimination parameter signals comprise at least two parameter signals selected from among said partial autocorrelation coefficient signals and said parameter signal $\rho_{MAX}$.

4. A speech processor according to claim 2, in which said parameter signals include a parameter signal $K_1$ representative of a partial autocorrelation coefficient signal of the signal samples at a delay of one sampling period, and wherein said means for generating discrimination parameter signals comprises:

a first converting means for converting said parameter $K_1$ into a log area ratio signal defined as log $(1+K_1)/(1-K_1)$, said log area ratio signal being used as one of said discrimination parameter signals.

5. A speech processor according to claim 2, in which said parameter signals include a parameter signal $\rho_{MAX}$ defined as the ratio of a maximum autocorrelation coefficient of the signal samples for a predetermined delay time range to the maximum autocorrelation coefficient of the signal samples for a zero delay time, and wherein said means for generating discrimination parameter signals comprises:

a second converting means for performing predetermined nonlinear conversion for said parameter signal $\rho_{MAX}$, said converted signal being used as one of said discrimination parameter signals.

* * * * *

UNITED STATES PATENT AND TRADEMARK OFFICE

CERTIFICATE OF CORRECTION

PATENT NO. : 4,360,708

DATED : November 23, 1982

INVENTOR(S) : Tetsu Taguchi; Kazuo Ochiai

It is certified that error appears in the above-identified patent and that said Letters Patent is hereby corrected as shown below:

Column 10, line 4 - change "tolerated." to --tolerated,--

Column 11, line 6 - change "$X_{1i}$ and $X_{2i}$" to --$\overline{X}_{1i}$ and $\overline{X}_{2i}$--

Column 11, line 47 - change "B" to --β--

Column 11, line 53 - change "B" to --β--

Column 11, line 55 - change "B" to --β--

Column 12, line 6 - change "B" to --β--

Column 13, line 8 (APPENDIX) - change "DO 50 1 = 1, 2" to --DO 50 I = 1, 2--

Signed and Sealed this

*Twelfth* Day of *July 1983*

[SEAL]

*Attest:*

GERALD J. MOSSINGHOFF

*Attesting Officer*

*Commissioner of Patents and Trademarks*